US012799768B2

(12) United States Patent
Yuan et al.

(10) Patent No.: US 12,799,768 B2
(45) Date of Patent: Nov. 17, 2026

(54) COVER CONNECTING ASSEMBLY, FOLDABLE OUTDOOR PRODUCT AND ASSEMBLING METHOD THEREOF

(71) Applicant: WITH-U E-COMMERCE (SHANGHAI) CO., LTD., Shanghai (CN)

(72) Inventors: Chunliang Yuan, Shanghai (CN); Shengyong Yang, Shanghai (CN)

(73) Assignee: WITH-U E-COMMERCE (SHANGHAI) CO., LTD., Shanghai (CN)

( * ) Notice: Subject to any disclaimer, the term of this patent is extended or adjusted under 35 U.S.C. 154(b) by 246 days.

(21) Appl. No.: 18/818,938

(22) Filed: Aug. 29, 2024

(65) Prior Publication Data

US 2024/0417999 A1 Dec. 19, 2024

Related U.S. Application Data

(63) Continuation of application No. PCT/CN2023/128060, filed on Oct. 31, 2023.

(30) Foreign Application Priority Data

Feb. 8, 2023 (CN) ..... 202320180846.2

(51) Int. Cl.
*E04H 15/64* (2006.01)
*E04H 15/48* (2006.01)
(Continued)

(52) U.S. Cl.
CPC ..... *E04H 15/64* (2013.01); *E04H 15/48* (2013.01); *B63B 17/02* (2013.01)

(58) Field of Classification Search
CPC ..... A45B 15/00; A45B 25/18; E04H 15/64; E04H 15/50; E04H 15/54; B63B 17/02;
(Continued)

(56) References Cited

U.S. PATENT DOCUMENTS 1,384,565 A * 7/1921 Martin ..... A43C 5/00 24/701
2,937,652 A * 5/1960 Zimmer, Jr. ..... B63B 17/02 114/361
(Continued)

FOREIGN PATENT DOCUMENTS

CN 2634029 Y 8/2004
CN 202073358 U 12/2011
(Continued)

OTHER PUBLICATIONS 5 page PDF of the Written Opinion mailed Feb. 8, 2023 in parent application PCT/CN2023/128060. (Year: 2023).*
(Continued)

*Primary Examiner* — Robert Canfield
(74) *Attorney, Agent, or Firm* — Schmeiser Olsen PLLC

(57) ABSTRACT

A cover connecting assembly is provided including a connecting band for connecting to a cover. The cover connecting assembly further is provided including a hanging member arranged on the connecting band, a connecting slot fitted with the connecting part opened on the hanging member. The connecting part is arranged on bars and being a part of a pivot or connected to a pivot, and the bars being configured to rotate around a rotating axis of the pivot, the connecting part is positioned in the connecting slot when the cover is connected to the bars. The connecting slot has an opening, and the opening is configured to allow the connecting part to enter the connecting slot in a direction perpendicular to or obliquely intersected with the rotating axis.

20 Claims, 12 Drawing Sheets

(51) Int. Cl.
*E04H 15/50* (2006.01)
*B63B 17/02* (2006.01)

(58) Field of Classification Search
CPC .. E04F 10/0629; E04F 10/0696; E06B 9/0661
USPC ..... 135/33.4, 33.41, 119
See application file for complete search history.

(56) References Cited

U.S. PATENT DOCUMENTS

| | | | | |
|---|---|---|---|---|
| 5,331,993 | A * | 7/1994 | Billbury | B63B 17/02 114/361 |
| 6,006,692 | A * | 12/1999 | Szukhent, Jr. | B63B 17/02 114/361 |
| 8,650,725 | B1 * | 2/2014 | Cooper | E04H 15/64 24/72.5 |
| 9,675,142 | B1 * | 6/2017 | Hendricks | A44B 13/0058 |
| 2014/0023429 | A1 * | 1/2014 | Lee | E04H 15/50 403/161 |
| 2014/0030006 | A1 * | 1/2014 | Lee | E04H 15/50 403/116 |
| 2014/0116488 | A1 | 5/2014 | Mallookis et al. | |
| 2016/0186457 | A1 * | 6/2016 | Mallookis | E04H 15/64 135/122 |
| 2019/0078605 | A1 | 3/2019 | Clasen et al. | |

FOREIGN PATENT DOCUMENTS

| | | | | |
|---|---|---|---|---|
| CN | 104398070 | A | 3/2015 | |
| CN | 208202768 | U | 12/2018 | |
| CN | 210858214 | U | 6/2020 | |
| CN | 112324238 | A | 2/2021 | |
| CN | 214740393 | U | 11/2021 | |
| CN | 219711172 | U | 9/2023 | |
| EP | 3098368 | A1 | 11/2016 | |
| EP | 4474600 | A1 * | 12/2024 | A47C 7/66 |
| JP | 49-18890 | | 5/1974 | |
| JP | 2025534185 | A * | 10/2025 | E04H 15/28 |
| KR | 20090041760 | A | 4/2009 | |
| KR | 100935458 | B2 | 1/2010 | |

OTHER PUBLICATIONS

International Search Report for PCT/CN2023/128060, mailed Dec. 5, 2023.

* cited by examiner

COVER CONNECTING ASSEMBLY, FOLDABLE OUTDOOR PRODUCT AND ASSEMBLING METHOD THEREOF

CROSS-REFERENCE TO RELATED APPLICATIONS

This application is a continuation of International Application No. PCT/CN2023/128060, filed on Oct. 31, 2023, which claims priority to Chinese Patent Application No. CN202320180846.2, filed on Feb. 8, 2023, both of which are hereby incorporated by reference in their entireties.

FIELD OF TECHNOLOGY

The following relates to the field of outdoor products, particularly relates to a cover connecting assembly, a foldable outdoor product and an assembling method thereof.

BACKGROUND

An outdoor canopy usually includes a canopy frame and a cover connected to the canopy frame, which is configured for sun shading, rain and wind sheltering, or the like, during outdoor activities. Currently, the cover of the canopy is mostly connected to the frame by hook and loop fasteners (also called hook and loop tapes, hook and loop bristles, or the like). However, for a foldable canopy, bars which can be relatively unfolded and folded (typically, cross-shaped connecting rod assemblies which are pivotally connected) are mostly adopted in an eave frame forming a top structure, and the aforementioned hook and loop fastener connection has the following problems: during unfolding or folding of the canopy, relative positions of the bars are changed, and the hook and loop fastener may slide on the bars, which cases an increasing abrasion of the bars: if it is located at or moved to a pivot joint of the bars, the hook and loop fastener is prone to be clamped and damaged by two bars close to each other; during unfolding or folding of the canopy, the position change of the bars may tear and damage the hook and loop fastener, a connecting band, or the like, connected thereto, and is also prone to cause mutual friction and scratching between the cover and protruding components on the bar (especially a connecting screw, a pin, or the like, at the pivot joint of the bar), so as to generate a scratch on the cover. Furthermore, when connecting the cover to the canopy frame, the hook and loop fastener is required to be operated with two hands, and the connecting positions are mostly high, which make the connection and assembly of the cover inconvenient.

SUMMARY

An aspect relates to a cover connecting assembly capable of conveniently connecting a cover to bars. The present disclosure further relates to a foldable outdoor product with the cover connecting assembly and an assembling method thereof.

An aspect of the present disclosure provides a cover connecting assembly, including:

a connecting band for connecting to a cover; and a hanging member arranged on the connecting band: a connecting slot fitted with a connecting part being opened on the hanging member;

wherein, the connecting part is arranged on bars and being a part of a pivot or connected to a pivot, and the bars being configured to rotate around a rotating axis of the pivot;

the connecting part is positioned in the connecting slot when the cover is connected to the bars;

the connecting slot has an opening, and the opening is configured to allow the connecting part to enter the connecting slot in a direction perpendicular to or obliquely intersected with the rotating axis.

In embodiments, a width of the opening is less than a diameter of the connecting part: the hanging member has a pair of guiding slopes, each of the guiding slopes has a proximal end close to the opening and a distal end far away from the opening, and a distance between the distal ends of the pair of guiding slopes is larger than that between the proximal ends. During the connecting process of the hanging member and the bars, the connecting part is extruded into the connecting slot through the opening between the pair of guiding slopes, and in a natural state, the connecting part cannot slide out of the connecting slot through the opening due to the small width of the opening.

In embodiments, the connecting slot has a C shape in whole.

In embodiments, the connecting band has a cover connecting end portion connected with the cover and an operating section extending downwards or inwards relative to the cover connecting end portion, and the hanging member is arranged on or adjacent to the cover connecting end portion. When the cover is connected, a user can pull the operating section to align the opening of the connecting slot with the connecting part, such that the connecting part can be clamped into the connecting slot conveniently, and can be automatically clamped into the connecting slot via the tension of the cover or the connecting band or manually pushed into the connecting slot.

In embodiments, the hanging member is sheet-like. The hanging member may have certain elasticity or is deformable.

In embodiments, the hanging member is made of a plastic sheet and has a stitching groove with a reduced wall thickness, the hanging member is stitched on the connecting band, and a stitch is located in the stitching groove. The hanging member has certain elasticity, and the connecting part can be extruded into the connecting slot through the opening.

In embodiments, the hanging member is sandwiched between the bars and the connecting band and covered by the connecting band.

In embodiments, the hanging member rotates around the connecting part during rotation of the bars, and the connecting part is covered by the connecting band to avoid mutual contact between the cover and the connecting part, thereby reducing or eliminating friction. Most connecting parts are protruded relative to bodies of the bars, for example, nut parts of pivot screws or connecting step portions on the bars: the connecting band always covers the protruding portion, and even in the rotating process of the bar, the hanging member rotates around the protruding portion, the protruding portion is still covered by the connecting band, and the cover is prevented from contacting the protruding portion, thus avoiding the mutual friction between the cover and the protruding connecting part, effectively protecting the cover, and preventing forming a scratch on the cover.

In embodiments, the cover covers at least a part of the bars.

In embodiments, the pivot has a cap and a body section inserted into the bars, the connecting part is located between the cap and the body section, diameters of the body section, the connecting part and the cap are sequentially increased, the connecting part has a limiting step surface, the limiting step surface abuts against an outer surface of the bars or a gasket is provided between the limiting step surface and the outer surface of the bars, and the connecting part is clamped into the connecting slot.

In some embodiments, the pivot has a body section and a cap with a diameter larger than that of the body section, the connecting part includes a spacing sleeve, the spacing sleeve is sleeved on an end portion of the body section close to the cap, and the spacing sleeve is clamped into the connecting slot.

In embodiments, the connecting part comprises a shaft sleeve arranged on the bars, the pivot is inserted into the bars and the shaft sleeve, and the shaft sleeve is clamped into the connecting slot.

A second aspect of the present disclosure provides a foldable outdoor product, including a frame and a cover arranged on the frame, wherein the foldable outdoor product further comprises a plurality of cover connecting assemblies, the bars are a part of the frame, and the cover is connected to the bars by a plurality of cover connecting assemblies.

In embodiments, the bars include a first rod and a second rod, and the first rod and the second rod are rotatably connected by the pivot to be unfolded or folded with respect to each other.

In embodiments, the foldable outdoor product is a canopy; the frame is a canopy frame, the canopy frame comprises a plurality of support legs and eave frames connected among the support legs, the eave frames comprise one or more said bars, said bars includes a first rod and a second rod, and the first rod and the second rod are rotatably connected by the pivot to be unfolded or folded with respect to each other.

In embodiments, the cover comprises a top fabric covering the eave frames, the cover connecting assembly includes a plurality of first cover connecting assemblies, an outer edge or a lower edge of the top fabric is connected to the eave frame by the first cover connecting assemblies, the eave frames comprises the first rod and the second rod, an end portion of the first rod and an end portion of the second rod are rotatably connected by the pivot, and the opening of the connecting slot of the first cover connecting assembly is oriented upwards. The top fabric of the canopy can be connected to the eave frames by the above cover connecting assembly, the connection is convenient, and connection strength is well.

In embodiments, the cover comprises a surrounding fabric hanging among or outside the frame legs, the cover connecting assembly comprises a plurality of second cover connecting assemblies, an upper edge of the surrounding fabric is connected to the eave frames by the second cover connecting assemblies, the eave frames comprises the first rod and the second rod, a middle of the first rod and a middle or an end portion of the second rod are rotatably connected by the pivot, and the opening of the connecting slot of the second cover connecting assembly is oriented downwards. The surrounding fabric on a side of the canopy can be connected to the eave frames by the above cover connecting assembly, the connection is convenient, and connection strength is well.

In embodiments, the foldable outdoor product is a foldable canopy, a sunshade, or a foldable chair.

In embodiments, the cover covers at least an upper or side portion of the frame.

Yet another aspect of the present disclosure provides an assembling method of a foldable outdoor product, including the following steps;

providing the foldable outdoor product; and pulling the connecting band or the hanging member to allow the connecting part to enter the connecting slot through the opening of the connecting slot, so as to connect the cover onto the bars.

In embodiments, the connecting band or the hanging member is pulled along a first direction, and when the connecting part is moved to the opening of the connecting slot, the connecting band is in a tensioning state: then the hanging member is moved relative to the bars in a second direction opposite to the first direction, such that the connecting part enters the connecting slot until the hanging member is hung on the connecting part.

In embodiments, the connecting band or the hanging member is pulled along a first direction, and when the connecting part is moved to the opening of the connecting slot, the connecting band is in a stretching state or a tensioning state; and then, the connecting band or the hanging member is released, and under an action of an elastic force or a tensioning force of the connecting band, the hanging member rebounds in a second direction opposite to the first direction, such that the connecting part enters the connecting slot.

In embodiments, the cover includes a top fabric of a canopy; the opening of the connecting slot is oriented upwards, the first direction is downward direction, and the second direction is upward direction; and/or, the cover includes a surrounding fabric of a canopy, the opening of the connecting slot is oriented downwards, the first direction is upward direction, and the second direction is downward direction.

The above solutions adopted in the present disclosure has the following advantages.

In the cover connecting assembly according to the present disclosure, the original pivot or connecting part of the bars is used, a hanging groove of the hanging member is clamped on the pivot or connecting part during connection, the cover can be conveniently connected on the bars, and particularly, the hanging member is connected on a pivot joint of the bars, a change of a position of the pivot joint relative to the cover in the rotation process of the bars is small or free, friction loss caused by sliding of a conventional connecting part, such as a hook and loop fastener, on the bars is avoided, the friction between the cover and the bars is reduced, which is convenient, the connection strength and stability are good, and the cover connecting assembly is suitable for being applied to the foldable outdoor product.

BRIEF DESCRIPTION

Some of the embodiments will be described in detail, with references to the following Figures, wherein like designations denote like members, wherein.

Figure 1:
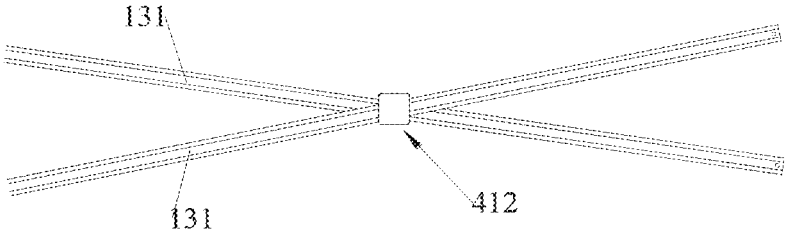
FIG. 1 is a structural view of a cover connecting assembly according to an embodiment of the present disclosure after connection.
Figure 2:
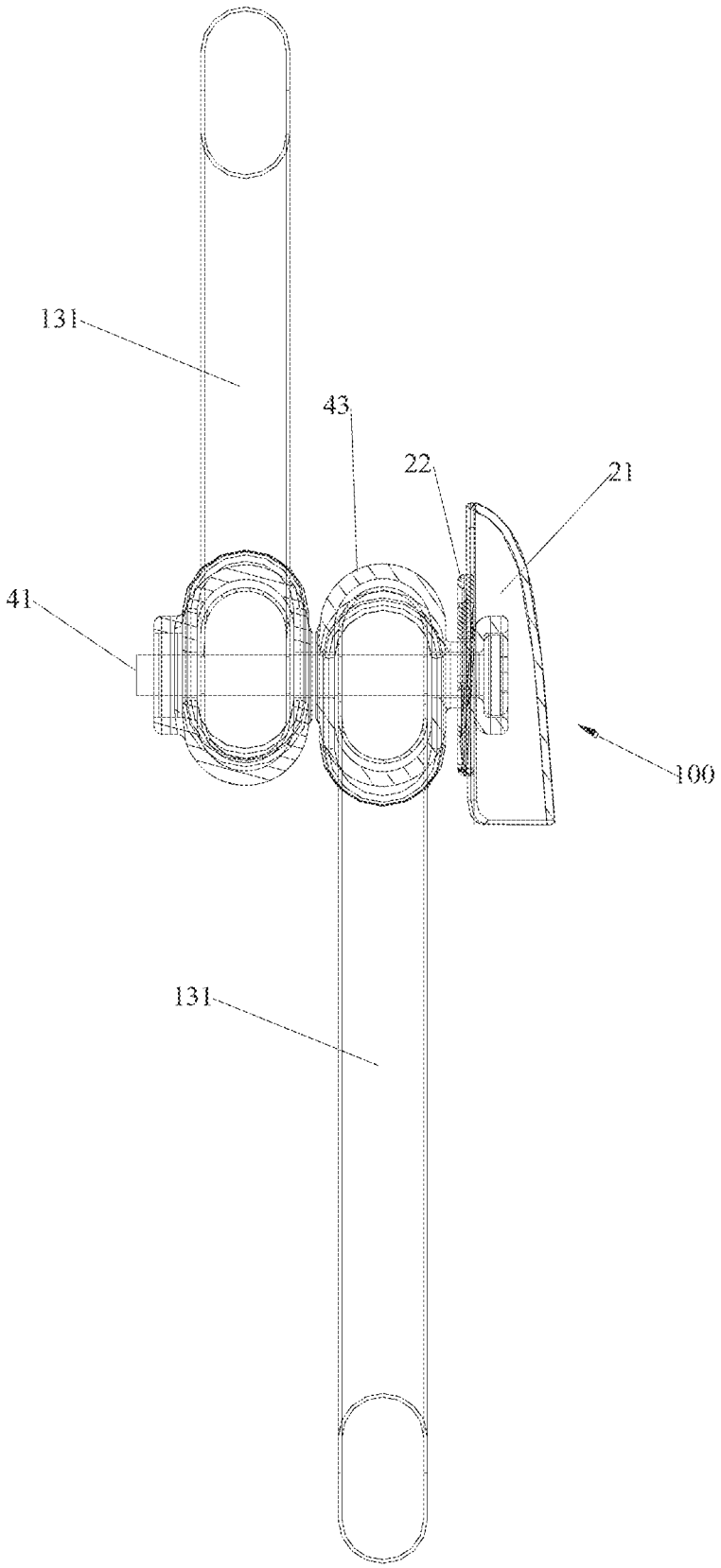
FIG. 2 is a sectional view of the cover connecting assembly according to the embodiment of the present disclosure.

Wherein:

100—cover connecting assembly;

131—bar; 1311—first rod; 1312—second rod;

21—connecting band; 211—cover connecting end; 212—operating section; 22—hanging member; 221—connecting slot; 222—guiding slope; 2221—proximal end; 2222—distal end; 223—stitching groove;

23—first cover connecting assembly; 24—second cover connecting assembly;

3—cover; 31—top fabric; 32—surrounding fabric;

41—pivot; 411—cap; 412—connecting part; 4121—limiting step surface; 413—body section; 42—reinforcing sleeve; 43—shaft sleeve;

5—gasket;

6—spacing sleeve;

200—canopy; 201—canopy frame; 202—support leg; and 203—eave frame.

DETAILED DESCRIPTION

Embodiments of the present disclosure are described in detail below with reference to the accompanying drawings, such that the advantages and features of the present disclosure can be more readily understood by those skilled in the conventional art. It should be noted that the description of the embodiments is intended to help understanding of the present disclosure but does not form limitation of the present disclosure. Furthermore, the technical features involved in the respective embodiments of the present disclosure described below may be combined with each other as long as they do not conflict with each other.

Referring to FIGS. 1 to 4, the present embodiment provides a cover connecting assembly 100 for connecting a cover 3 to bars 131. The cover connecting assembly 100 includes a connecting part 412 provided on the bars 131, and the bars 131 are configured to rotate around a rotating axis of a pivot 41. The connecting part 412 is a part of the pivot 41 or connected to the pivot 41, and in the present embodiment, the connecting part 412 is connected to the pivot 41.

Figure 3:
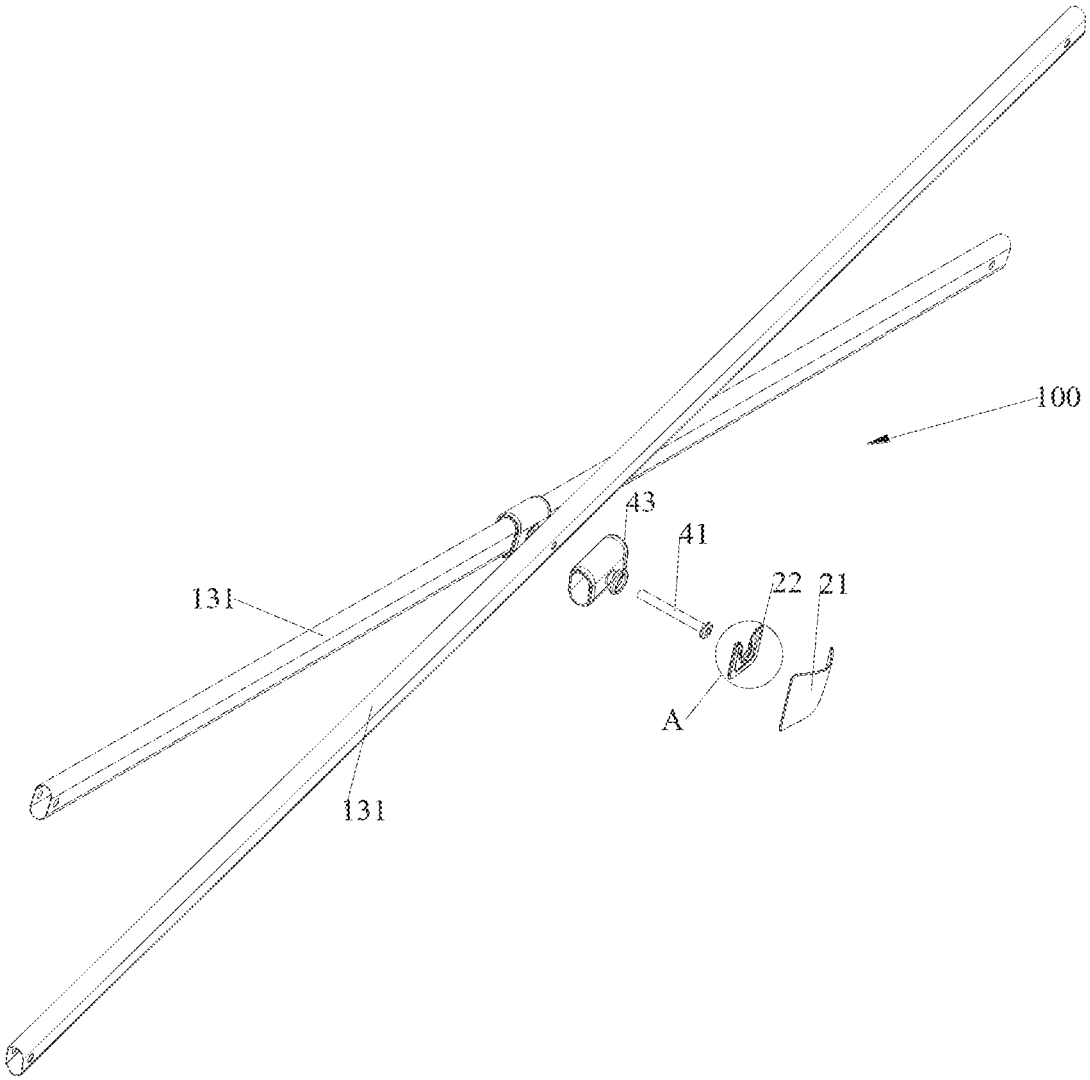
FIG. 3 is an exploded view of the cover connecting assembly according to the embodiment of the present disclosure.

Further, the cover connecting assembly 100 further includes a connecting band 21 and a hanging member 22, and the connecting band 21 is connected with the cover 3 in a stitching manner. The hanging member 22 is provided on the connecting band 21. As shown in FIG. 3, the hanging member 22 is positioned between the bars 131 and the connecting band 21 and covered by the connecting band 21, and the cover 3 covers at least a part of the bars 131.

Figure 4:
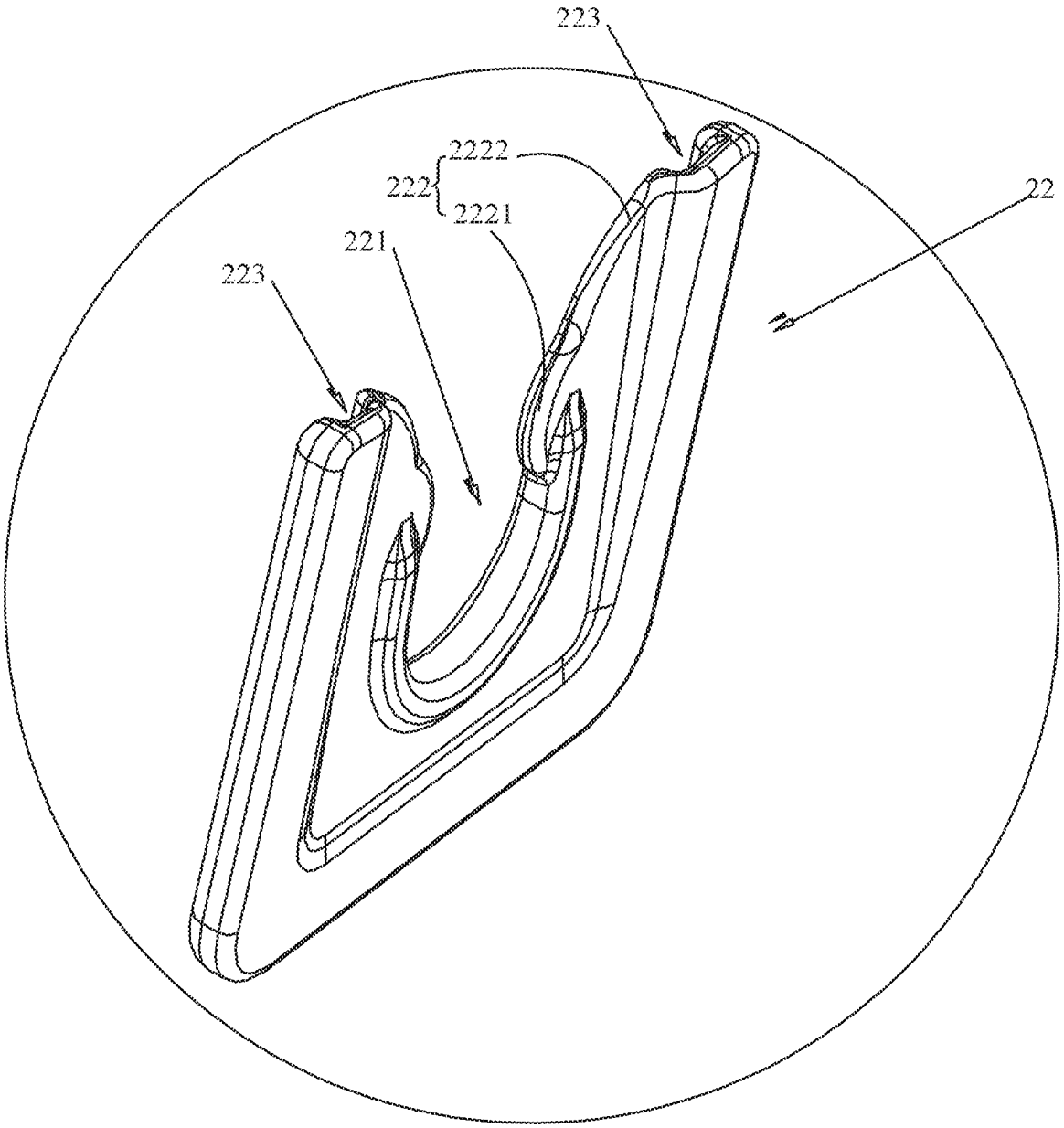
FIG. 4 is a partial enlarged view at A in FIG. 3.

Still further, referring to FIG. 4, the hanging member 22 is sheet-like and made of a plastic sheet (having certain elasticity) and has a stitching groove 223 with a reduced wall thickness. The connecting band 21 may be a polypropylene woven band, the hanging member 22 is stitched to the connecting band 21, and a stitch is positioned in the stitching groove 223. The hanging member 22 has a connecting slot 221 fitted with the connecting part 412 and a pair of guiding slopes 222, and the connecting part 412 is positioned in the connecting slot 221.

Referring to FIG. 4, the connecting slot 221 has a C shape in whole, the connecting slot 221 has an opening, and a width of the opening is smaller than a diameter of the connecting part 412, such that the connecting part 412 is not prone to slide out of the opening. The opening is configured to allow the connecting part 412 to enter the connecting slot 221 in a direction perpendicular to or obliquely intersected with the rotating axis. Each of the guiding slopes 222 has a proximal end 2221 close to the opening and a distal end 2222 far away from the opening, and a distance between the distal ends 2222 of the pair of guiding slopes 222 is greater than that between the proximal ends 2221. During connection between the hanging member 22 and the bars 131, the connecting part 412 is extruded into the connecting slot 221 from the pair of guiding slopes 222. In a natural state, the connecting part 412 cannot slide out of the connecting slot 211 through the opening due to a small width of the opening.

The connecting part 412 in the embodiment is specifically a shaft sleeve 43 arranged on the bars 131, the pivot 41 is inserted into the bars 131 and the shaft sleeve 43, and the shaft sleeve 43 is clamped into the connecting slot 221. During rotation of the bars 131, the hanging member 22 rotates around the shaft sleeve 43, and the shaft sleeve 43 is covered by the connecting band 21 to avoid mutual contact between the cover and the shaft sleeve 43. The shaft sleeve 43 is protruding relative to a body of the bars, the connecting band always covers the protruding shaft sleeve 43, and even in the rotating process of the bars 131, the hanging member 22 rotates around the shaft sleeve 43, the shaft sleeve 43 is still shielded by the connecting band, and the cover is prevented from contacting the shaft sleeve 43, thus avoiding mutual friction between the cover and the protruding shaft sleeve 43, effectively protecting the cover, and preventing forming a scratch on the cover.

The connecting band 21 in the embodiment connects the cover 3 to the bars 131, and the connecting band 21 is stitched to the hanging member 22. The connecting part 412 on the bars 131 includes a shaft sleeve 43 provided on the bars 131, the pivot 41 is inserted into the bars 131 through the shaft sleeve 43, and the shaft sleeve 43 is clamped into the connecting slot 221 of the hanging member 22. The cover connecting assembly 100 is convenient to use, has good connecting strength and stability and is suitable for being applied to a foldable outdoor product.

Figure 5:
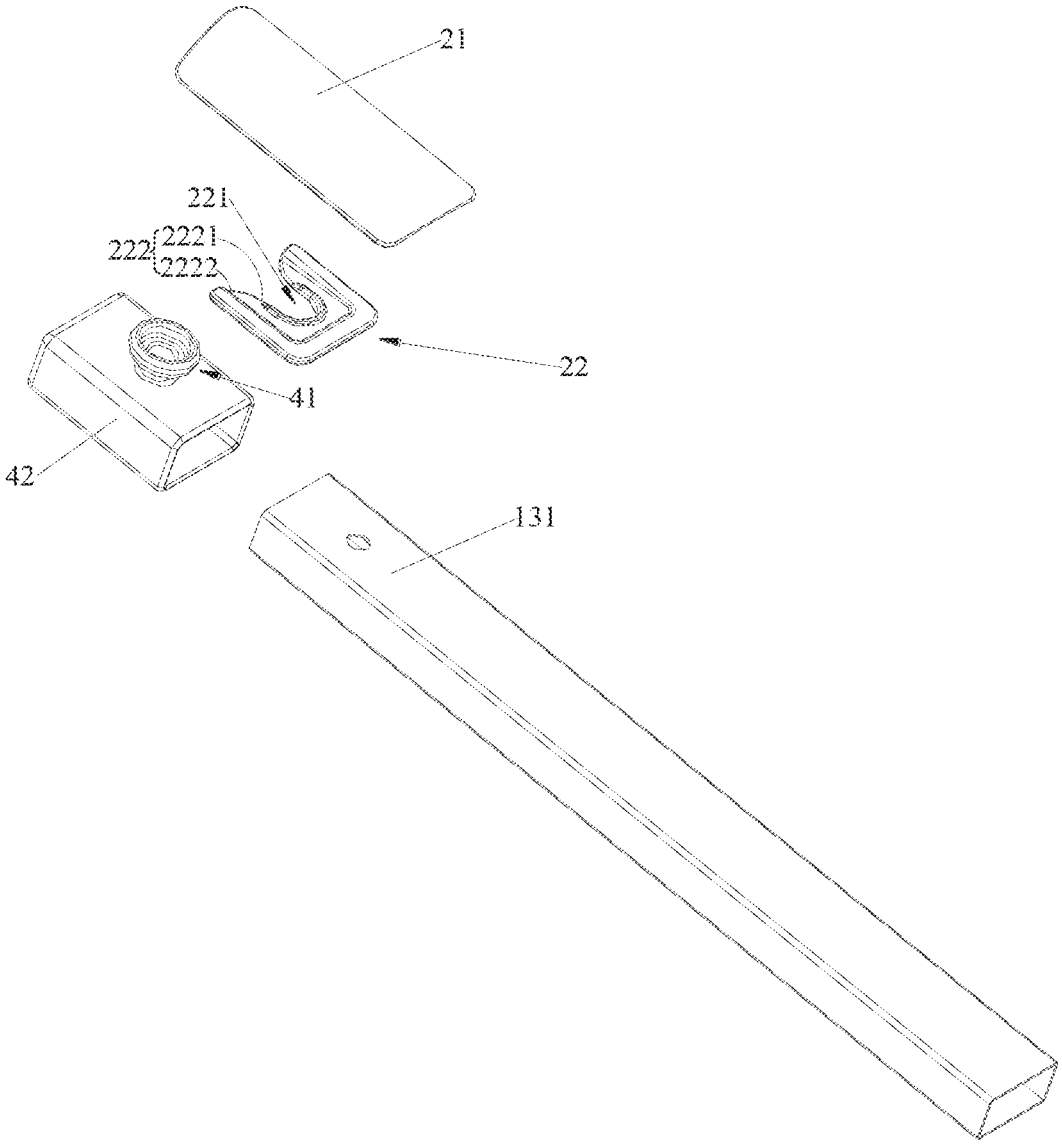
FIG. 5 is an exploded view of another cover connecting assembly according to the embodiment of the present disclosure.
Figure 6:
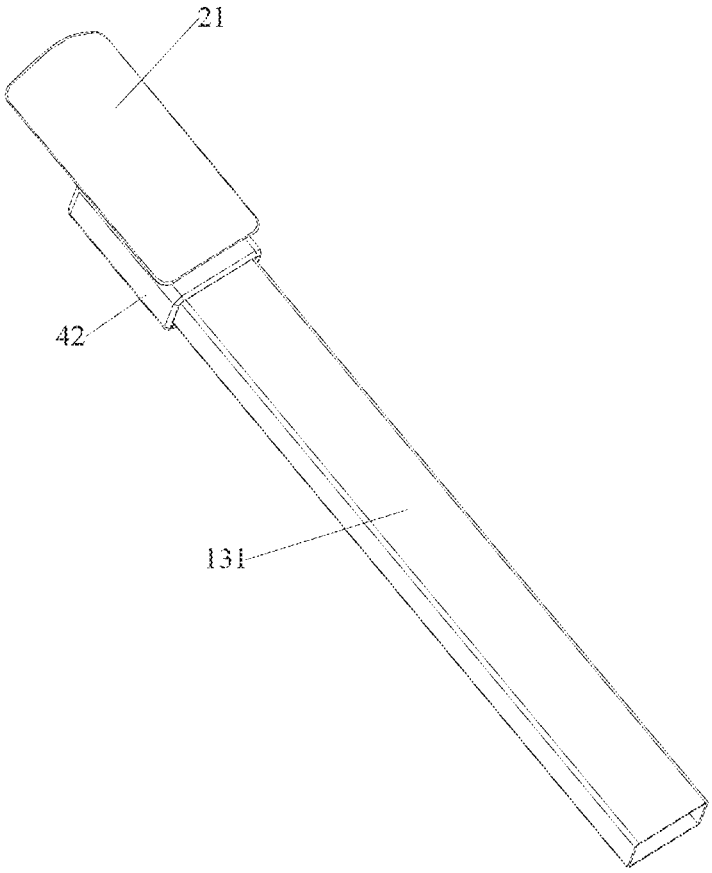
FIG. 6 is a structural view of another cover connecting assembly according to the embodiment of the present disclosure after connection.

FIGS. 5 and 6 show another cover connecting assembly according to the present embodiment, which is different from the cover connecting assembly shown in FIGS. 1 to 4 in that: the connecting part 412 is located at an end portion of the bars 131. The cover connecting assembly 100 further includes a reinforcing sleeve 42, the reinforcing sleeve 42 is sleeved on the bars 131, the shaft sleeve 43 is located on the reinforcing sleeve 42 and protrudes outwards from the shaft sleeve 43, and the reinforcing sleeve 42 and the shaft sleeve 43 can be fixedly connected or integrally formed. The reinforcing sleeve 42 is a plastic tubular part, and the reinforcing sleeve is sleeved on the end portion or a middle, especially a pivot joint, of the bars for reinforcing strength of the bars. The pivot 41 is inserted into the reinforcing sleeve 42, the bars 131 and the shaft sleeve 43.

Figure 7:
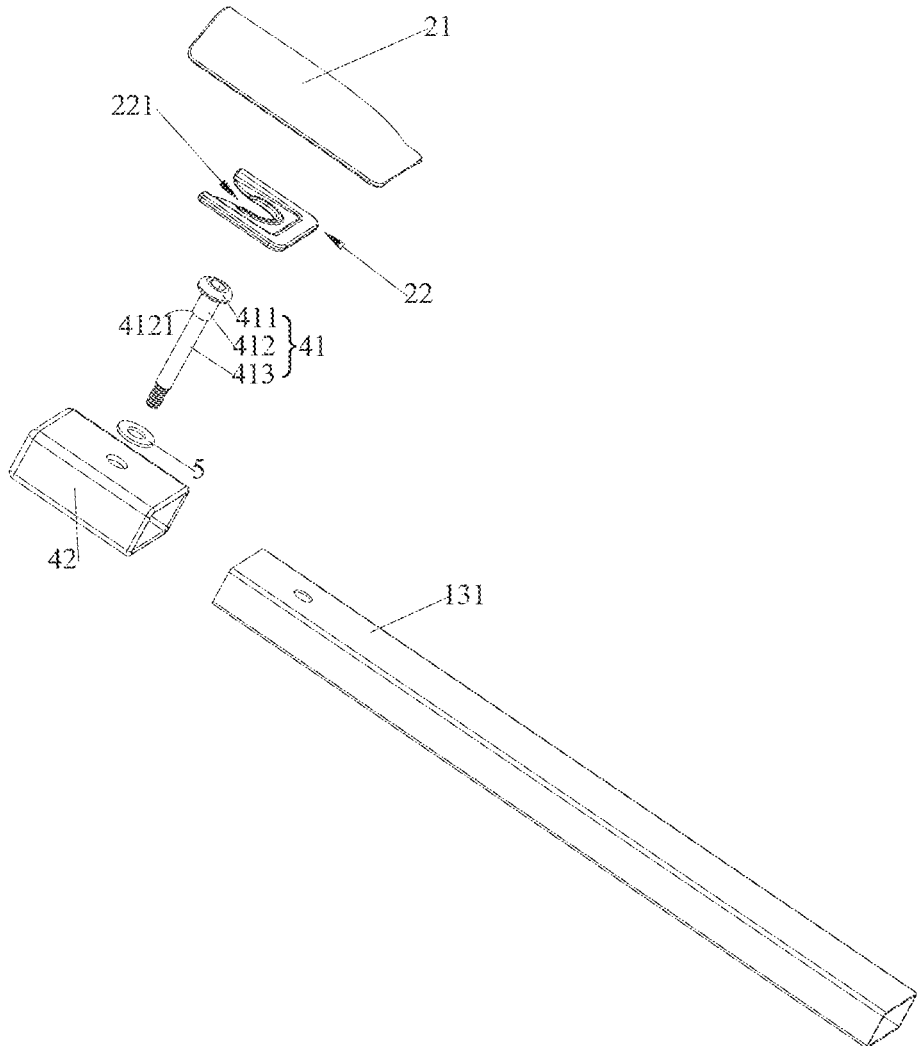
FIG. 7 is an exploded view of still another cover connecting assembly according to the embodiment of the present disclosure.

FIG. 7 shows still another cover connecting assembly according to the present embodiment, which is different from the cover connecting assembly shown in FIGS. 1 to 4 in that: (1) the connecting part 412 is located at the end portion of the bars 131: (2) the connecting part 413 is a part of the pivot 41. Specifically, the pivot 41 has a cap 411 and a body section 413 inserted into the bars 131, the connecting part 421 is positioned between the cap 411 and the body section 413, diameters of the body section 413, the connecting part 412 and the cap 411 are sequentially increased, the connecting part 412 has a limiting step surface 4121, the limiting step surface 4121 abuts against an outer surface of the bars 131 or a gasket 5 is arranged between the limiting step surface 4121 and the outer surface of the bars 131, and specifically, in the embodiment, a gasket 5 is provided between the limiting step surface 4121 and the outer surface of the bars 131, and the connecting part 412 is clamped into the connecting slot 221. The cover connecting assembly 100 according to the present embodiment may be located at the end portions of two bars 131 or the middles of two bars 131.

Figure 8:
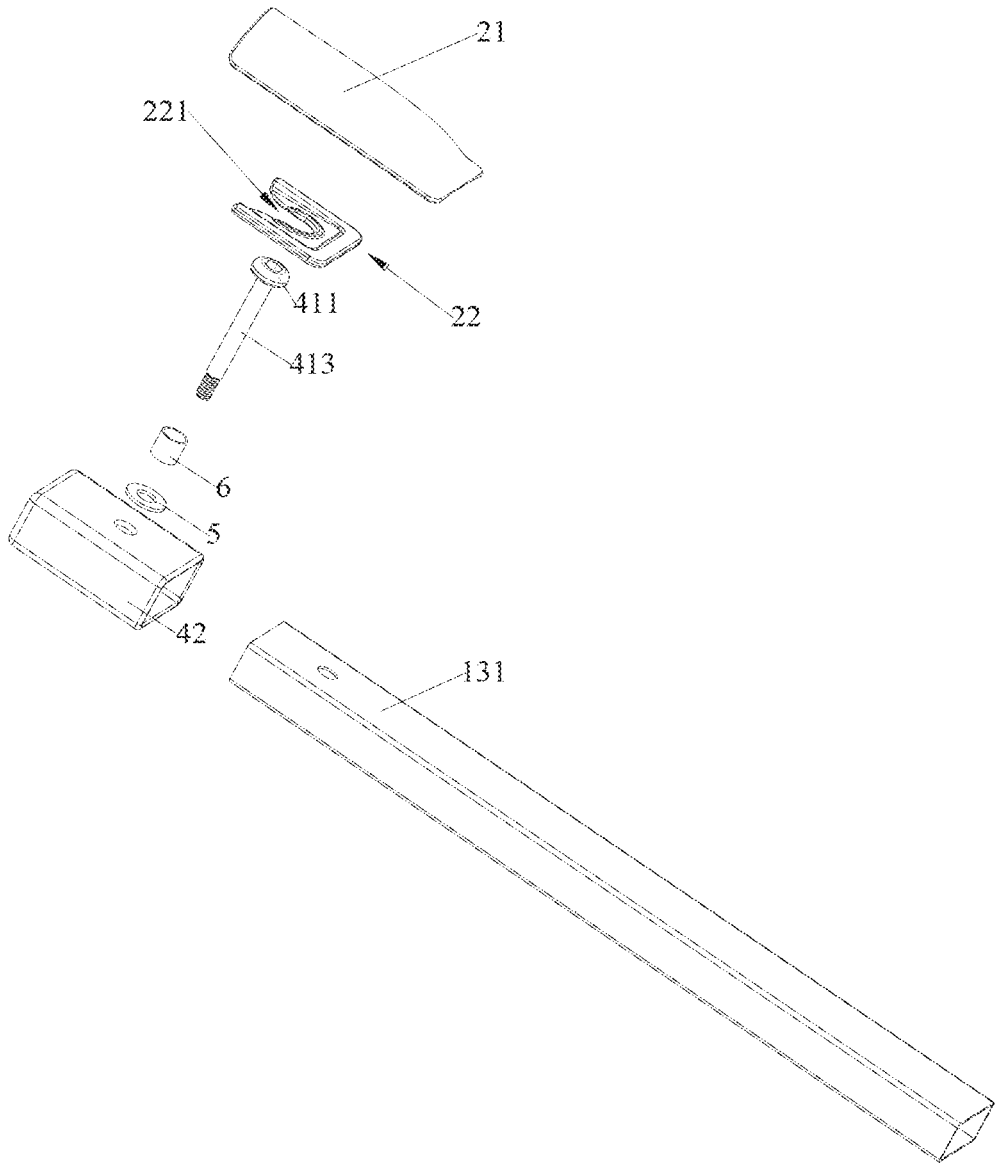
FIG. 8 is an exploded view of a fourth cover connecting assembly according to the embodiment of the present disclosure.

FIG. 8 shows a fourth cover connecting assembly according to the present embodiment, which is different from the cover connecting assemblies shown in FIGS. 1 to 4 in that: (1) the connecting part 412 is located at the end portion of the bars 131: (2) the connecting part 412 is a spacing sleeve 6. Specifically, the pivot 41 has a body section 413 and a cap 411 with a diameter larger than that of the body section 413, the spacing sleeve 6 is sleeved on an end portion of the body section 413, the spacing sleeve 6 is clamped into the connecting slot 221, and a gasket 5 is arranged between the outer surface of the bars 131 and the spacing sleeve 6.

Figure 9:
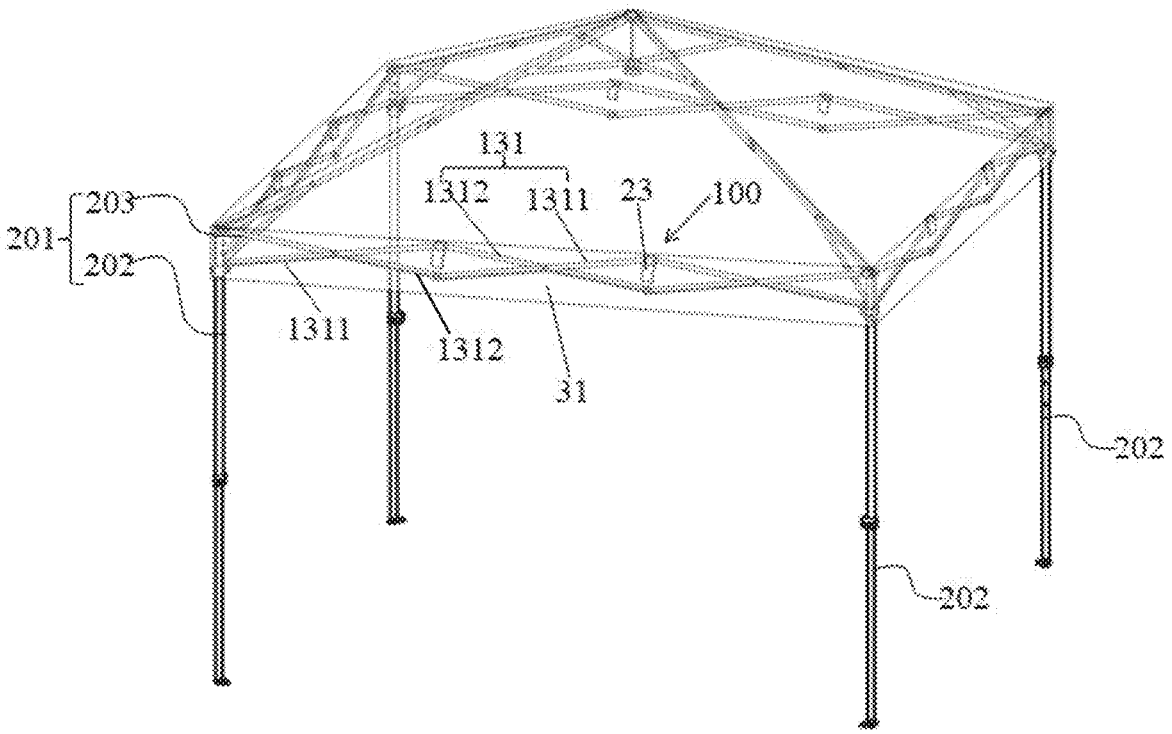
FIG. 9 is a structural view of a canopy according to an embodiment of the present disclosure.
Figure 10:
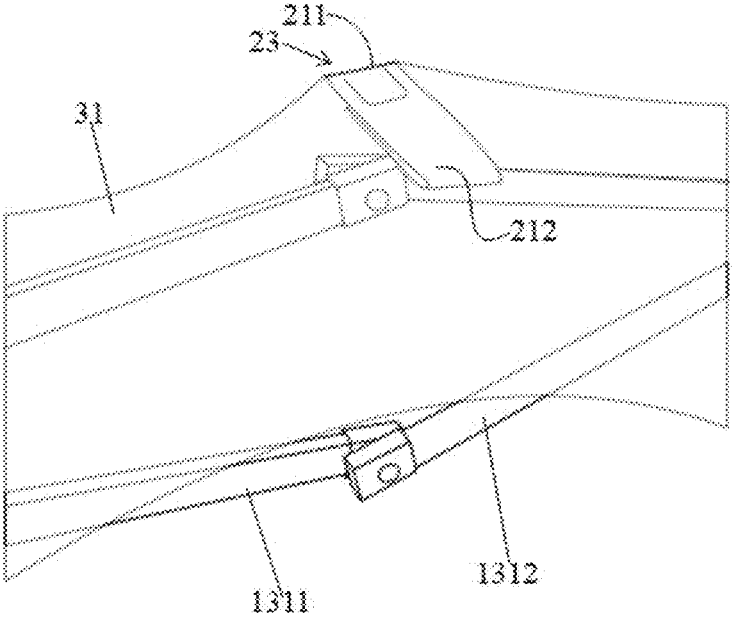
FIG. 10 is a schematic diagram of a cover connecting process of the canopy according to the embodiment of the present disclosure.
Figure 11:
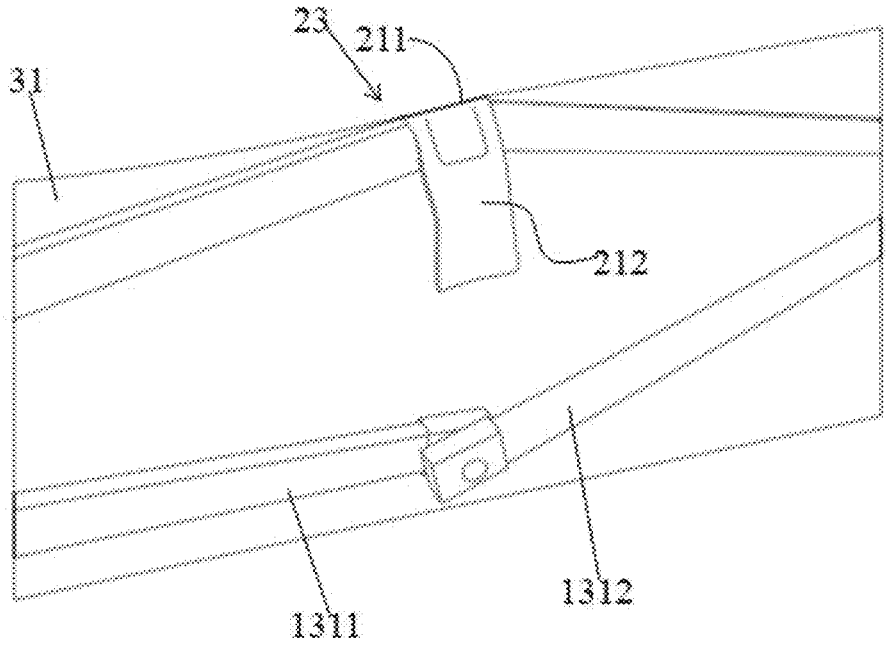
FIG. 11 is a schematic diagram of the canopy according to the embodiment of the present disclosure after a cover is connected with bars.
Figure 12:
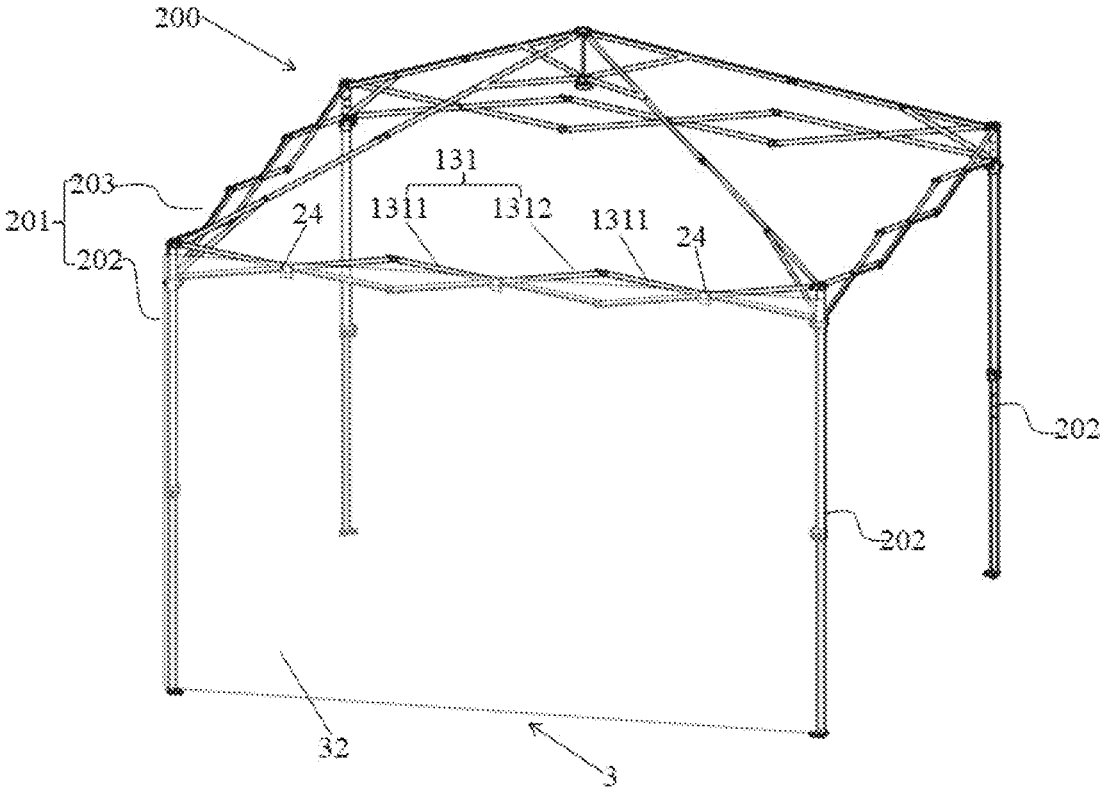
FIG. 12 is a structural view of another canopy according to the embodiment of the present disclosure with a top fabric not shown.
Figure 13:
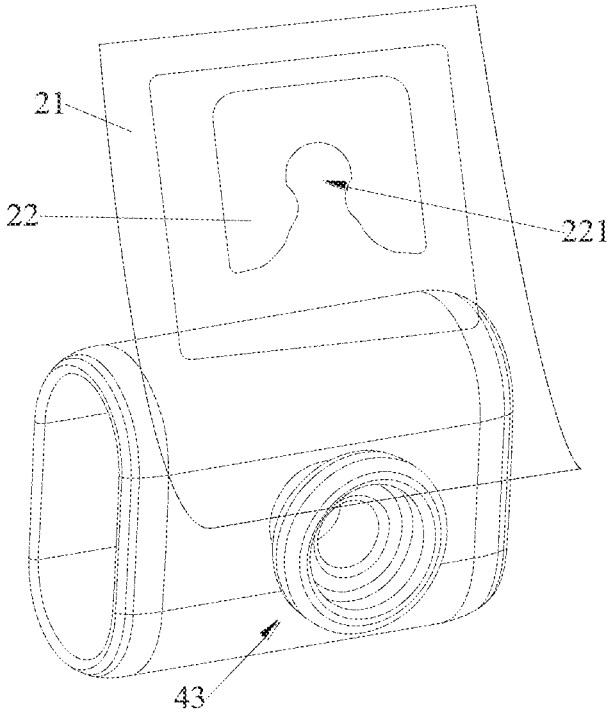
FIG. 13 is a schematic diagram of a process of connecting a hanging member and a shaft sleeve of another canopy according to the embodiment of the present disclosure.
Figure 14:
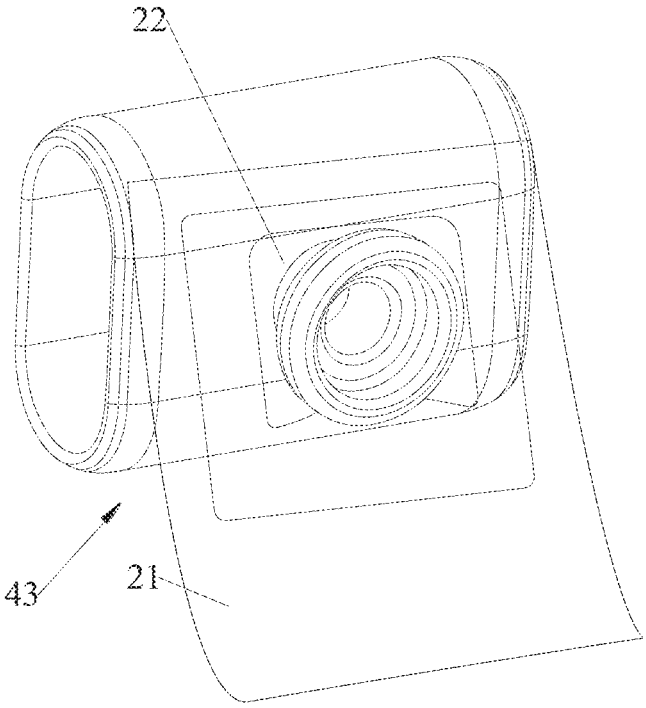
FIG. 14 is a schematic diagram of another canopy according to the embodiment of the present disclosure after the hanging member is connected with the shaft sleeve.
Figure 15:
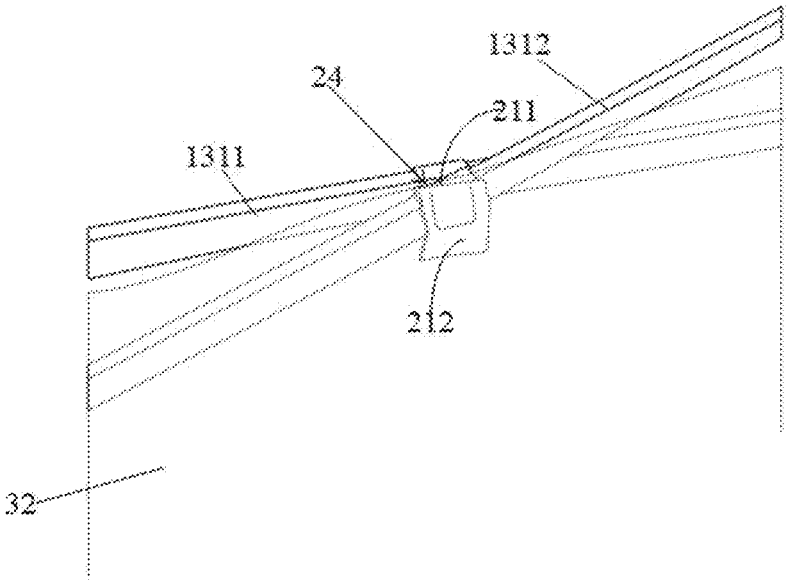
FIG. 15 is a schematic partial diagram of another canopy according to the embodiment of the present disclosure.

FIGS. 9 to 11 show a foldable outdoor product according to the present embodiment, which may be a foldable canopy, a sunshade, or a foldable chair. The foldable outdoor product includes a frame, a cover 3 provided on the frame and the above cover connecting assembly 100, the bars 131 are a part of the frame, the cover 3 is connected to the bars 131 by a plurality of cover connecting assemblies 100, and the cover 3 at least covers an upper or side portion of the frame. Specifically, in the embodiment, the foldable outdoor product is a canopy 200. The cover connecting assembly in the present embodiment is the cover connecting assembly shown in FIGS. 5 to 6.

Referring to FIG. 9, the frame is a canopy frame 201, the canopy frame 201 includes a plurality of support legs 202 and eave frames 203 connected among the support legs 202, and each eave frame 203 includes one or more bars 131. Each bar 131 includes a first rod 1311 and a second rod 1312 provided obliquely up and down, and middles of the first rod 1311 and the second rod 1312 are rotatably connected by the pivot 41, such that the first rod 1311 and the second rod 1312 can be relatively unfolded or folded. Each bar 131 substantially has a cross shape. The plurality of bars 131 are pivotally connected in sequence: for example, in FIG. 9, an upper end portion of the first rod 1311 of the left bar 131 and an upper end portion of the second rod 1312 of the middle bar 131 are pivotally connected to form an upper pivot joint, and a lower end portion of the second rod 1312 of the left bar 131 and a lower end portion of the first rod 1311 of the middle bar 131 are pivotally connected to form a lower pivot joint: the upper pivot joints are level and the lower pivot joints are level. The connecting parts of the above cover connecting assembly are all provided at the upper pivot joints. In the embodiment, the eave frame 203 basically includes a plurality of the above-described bars 131, so as to be transversely extendable and retractable in a left-right direction or a front-rear direction.

The cover 3 is a top fabric 31 covering the eave frame 203, the top fabric 31 is connected to the eave frame 203 by the above cover connecting assembly 100, the connection is convenient, and connection strength is well. Further, the cover connecting assembly 100 includes a plurality of first cover connecting assemblies 23 (i.e., the cover connecting assembly according to the second embodiment), an outer edge or a lower edge of the top fabric 31 is connected to the eave frame 203 by the first cover connecting assemblies 23, the eave frame 203 includes the first rod 1311 and the second rod 1312, the pivot 41 rotatably connects an end portion of the first rod 1311 and an end portion of the second rod 1312, and the opening of the connecting slot 221 of the first cover connecting assembly 23 is oriented upwards.

Referring to FIGS. 10 and 11, the connecting band 21 has a cover connecting end portion 211 connected with the top fabric 31 and an operating section 212 extending downwards relative to the cover connecting end portion 211, and the hanging member 22 is provided on or close to the cover connecting end portion 211. When the top fabric 31 is connected, a user can pull the operating section 212 to align the opening of the connecting slot 221 with the connecting part 412, such that the connecting part 412 can be clamped into the connecting slot 212 conveniently, and can be automatically clamped into the connecting slot with tension of the top fabric 31 or the connecting band 21, or manually pushed into the connecting slot.

FIGS. 12 to 15 show another canopy according to the present embodiment. The canopy frame of the canopy is substantially the same as that of the canopy shown in FIGS. 9 to 11, except that: the cover 3 further includes a surrounding fabric 32 hanging among or outside the support legs 202, the surrounding fabric 32 is connected to the eave frame 203 by a plurality of cover connecting assemblies 100 as described in FIGS. 1 to 4, the connection is convenient, and connection strength is well.

The cover connecting assembly 100 includes a plurality of second cover connecting assemblies 24 (i.e., the cover connecting assembly shown in FIGS. 1 to 4), an upper edge of the surrounding fabric 32 is connected to the eave frame 203 by the second cover connecting assemblies 24, the eave frame 203 includes the first rod 1311 and the second rod 1312, the pivot 41 rotatably connects a middle of the first rod 1311 and a middle of the second rod 1312, and the opening of the connecting slot 221 of the second cover connecting assembly 24 is oriented downwards.

The connecting band 21 has a cover connecting end portion 211 connected with the surrounding fabric 32 and an operating section 212 extending downwards relative to the cover connecting end portion 211, and the hanging member 22 is provided on or close to the cover connecting end portion 211. When the surrounding fabric 32 is connected, the opening of the connecting slot 221 is aligned with the connecting part 412, and the user can pull the operating section 212 to facilitate the connecting part 412 to be clamped into the connecting slot 212.

As used in this specification and the appended claims, the terms "include" and "comprise" are intended to include only the explicitly recited steps and elements, these steps and elements do not constitute an exclusive list, and in embodiments the method or apparatus may include other steps or elements. The term "and/or" used herein includes any combination of one or more related listed items.

The indefinite articles "a" and "an" preceding an element or component herein are intended to describe without limitation the number of instances (i.e., occurrences) of the element or component, unless the context clearly indicates otherwise. Therefore, the terms "a" and "an" are to be construed as including one or at least one and the singular form of the element or component also include the plural form.

It should be noted that, unless otherwise specified, when a feature is referred to as being "fixed" or "connected" to another feature, it can be directly fixed or connected to the other feature or indirectly fixed or connected to the other feature. In addition, the terms "upper", "lower", "left", "right", etc. used in the present disclosure are described only relative to the mutual position relationship of the components of the present disclosure in the drawings.

It may be further understood that the terms "first", "second", or the like, are used to describe various information, but the information should not be limited by these terms. These terms are only used to distinguish the information of the same type, and do not indicate a particular order or degree of importance. Indeed, the terms "first", "second", or the like, are used interchangeably throughout. For example, first information may also be referred to as second information, and similarly, second information may also be referred to as first information, without departing from the scope of the present disclosure.

Although the present invention has been disclosed in the form of embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The invention claimed is:

1. A cover connecting assembly, comprising:

a connecting band for connecting to a cover; and a hanging member arranged on the connecting band; and a connecting slot fitted with a connecting part being opened on the hanging member;

wherein, the connecting part is arranged on bars and being a part of a pivot or connected to a pivot, and the bars being configured to rotate around a rotating axis of the pivot;

wherein the connecting part is positioned in the connecting slot when the cover is connected to the bars;

wherein the connecting slot has an opening, and the opening is configured to allow the connecting part to enter the connecting slot in a direction perpendicular to or obliquely intersected with the rotating axis.

2. The cover connecting assembly according to claim 1, wherein a width of the opening is less than a diameter of the connecting part; the hanging member has a pair of guiding slopes, each of the guiding slopes has a proximal end close to the opening and a distal end far away from the opening, and a distance between the distal ends of the pair of guiding slopes is larger than that between the proximal ends.

3. The cover connecting assembly according to claim 1, wherein the connecting slot has a C shape in whole.

4. The cover connecting assembly according to claim 1, wherein the connecting band has a cover connecting end portion connected with the cover and an operating section extending downwards or inwards relative to the cover connecting end portion, and the hanging member is arranged on or adjacent to the cover connecting end portion.

5. The cover connecting assembly according to claim 1, wherein the hanging member is sheet-like.

6. The cover connecting assembly according to claim 5, wherein the hanging member is made of a plastic sheet and has a stitching groove with a reduced wall thickness, the hanging member is stitched on the connecting band, and a stitch is positioned in the stitching groove.

7. The cover connecting assembly according to claim 1, wherein the hanging member has elasticity or is deformable.

8. The cover connecting assembly according to claim 1, wherein the hanging member is sandwiched between the bars and the connecting band and covered by the connecting band.

9. The cover connecting assembly according to claim 1, wherein the cover covers at least a part of the bars, the hanging member is configured to rotate around the connecting part during rotation of the bars, and the connecting part is covered by the connecting band to avoid mutual contact between the cover and the connecting part.

10. The cover connecting assembly according to claim 1, wherein the pivot has a cap and a body section inserted into the bars, the connecting part is located between the cap and the body section, diameters of the body section, the connecting part and the cap are sequentially increased, the connecting part has a limiting step surface, the limiting step surface abuts against an outer surface of the bars or a gasket is provided between the limiting step surface and the outer surface of the bars, and the connecting part is clamped into the connecting slot.

11. The cover connecting assembly according to claim 1, wherein the pivot has a body section and a cap with a diameter larger than that of the body section, the connecting part comprises a spacing sleeve, the spacing sleeve is sleeved on an end portion of the body section close to the cap, and the spacing sleeve is clamped into the connecting slot.

12. The cover connecting assembly according to claim 1, wherein the connecting part comprises a shaft sleeve arranged on the bars, the pivot is inserted into the bars and the shaft sleeve, and the shaft sleeve is clamped into the connecting slot.

13. A foldable outdoor product, comprising a frame and a cover arranged on the frame, wherein the foldable outdoor product further comprises a plurality of cover connecting assemblies according to claim 1, the bars are a part of the frame, and the cover is connected to the bars by a plurality of cover connecting assemblies.

14. The foldable outdoor product according to claim 13, wherein the bars include a first rod and a second rod, and the first rod and the second rod are rotatably connected by the pivot to be unfolded or folded with respect to each other.

15. The foldable outdoor product according to claim 13, wherein the foldable outdoor product is a canopy, the frame is a canopy frame, the canopy frame comprises a plurality of support legs and eave frames connected among the support legs, the eave frames comprise one or more said bars, said bars includes a first rod and a second rod, and the first rod and the second rod are rotatably connected by the pivot to be unfolded or folded with respect to each other.

16. The foldable outdoor product according to claim 15, wherein the cover comprises a top fabric covering the eave frames, the cover connecting assembly includes a plurality of first cover connecting assemblies, an outer edge or a lower edge of the top fabric is connected to the eave frames by the first cover connecting assemblies, the eave frames comprises the first rod and the second rod, an end portion of the first rod and an end portion of the second rod are rotatably connected by the pivot, and the opening of the connecting slot of the first cover connecting assembly is oriented upwards; and/or the cover comprises a surrounding fabric hanging among or outside the frame legs, the cover connecting assembly comprises a plurality of second cover connecting assemblies, an upper edge of the surrounding fabric is connected to the eave frames by the second cover connecting assemblies, the eave frames comprises the first rod and the second rod, a middle of the first rod and a middle or an end portion of the second rod are rotatably connected by the pivot, and the opening of the connecting slot of the second cover connecting assembly is oriented downwards.

17. The foldable outdoor product according to claim 13, wherein the foldable outdoor product is a foldable canopy, a sunshade, or a foldable chair, and the cover covers at least an upper or side portion of the frame.

18. An assembling method of a foldable outdoor product, comprising the following steps:

providing the foldable outdoor product according to claim 1; and pulling the connecting band or the hanging member to allow the connecting part to enter the connecting slot through the opening of the connecting slot, so as to connect the cover onto the bars.

19. The assembling method according to claim 18, wherein the connecting band or the hanging member is pulled along a first direction, the connecting band is in a tensioning state when the connecting part moves to the opening of the connecting slot, then the hanging member is moved relative to the bars in a second direction opposite to the first direction, such that the connecting part enters the connecting slot until the hanging member is hung on the connecting part.

20. The assembling method according to claim 19, wherein the cover includes a top fabric of a canopy, the opening of the connecting slot is oriented upwards, the first direction is downward direction, and the second direction is upward direction; and/or, the cover includes a surrounding fabric of a canopy, the opening of the connecting slot is oriented downwards, the first direction is upward direction, and the second direction is downward direction.

* * * * *